US010994158B2

(12) United States Patent
Sernfält et al.

(10) Patent No.: US 10,994,158 B2
(45) Date of Patent: May 4, 2021

(54) HEATING FOR POWERED AIR UNIT

(71) Applicant: 3M INNOVATIVE PROPERTIES COMPANY, St. Paul, MN (US)

(72) Inventors: Mats Ulrik Sernfält, Leksand (SE); Fredrik A. Nisser, Lund (SE); Michal S. Szulmanowicz, Wroclaw (PL)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 552 days.

(21) Appl. No.: 14/062,168

(22) Filed: Oct. 24, 2013

(65) Prior Publication Data

US 2015/0114389 A1 Apr. 30, 2015

(51) Int. Cl.
*A62B 9/00* (2006.01)
*A62B 18/00* (2006.01)
(Continued)

(52) U.S. Cl.
CPC ..... *A62B 9/003* (2013.01); *A62B 9/006* (2013.01); *A62B 18/006* (2013.01); *A62B 7/10* (2013.01); *A62B 18/02* (2013.01)

(58) Field of Classification Search
CPC ..... A62B 9/006; A62B 9/003; A62B 18/006; A62B 18/02; A62B 7/10; A61M 2016/0039; A61M 16/0066; A61M 16/1075; A61M 16/109; A61M 16/1095; A61M 16/16; A61M 16/161;
(Continued)

(56) References Cited

U.S. PATENT DOCUMENTS

RE20,135 E 10/1932 Bjurstrom
3,217,539 A * 11/1965 Owen ..... G01F 1/103 73/861.77
(Continued)

FOREIGN PATENT DOCUMENTS

DE 102011118120 5/2013
RU 2076744 C1 4/1997
(Continued)

OTHER PUBLICATIONS

International Search Report for PCT Application No. PCT/US2014/061288 dated Mar. 5, 2015, 4 pages.
(Continued)

*Primary Examiner* — Victoria Murphy
(74) *Attorney, Agent, or Firm* — Steven A. Bern; Emily M. Van Vliet

(57) ABSTRACT

A powered air purifying respirator (PAPR) with an active heating system. The PAPR includes a powered air component designed to be carried by a user of the PAPR, the powered air component including a fan and a filter, wherein the fan draws air from a user's environment through the filter. The PAPR further includes an electronically controlled active heating element and a control system. The control system varies the power provided to the heating element and further disables the heating element when potential overheating of the heating element is detected. The present invention further includes a heating module for use with a PAPR. The heating module includes an electronically controlled active heating element. The heating element is disabled when the fan in the PAPR is not rotating.

20 Claims, 3 Drawing Sheets

(51) Int. Cl.
*A62B 7/10* (2006.01)
*A62B 18/02* (2006.01)

(58) Field of Classification Search
CPC .. A61M 2205/3368; A61M 2205/3372; A61M 2205/36; A61M 2205/362; A61M 2205/3653; A61M 2205/3666; A61M 2205/502
See application file for complete search history.

(56) References Cited

U.S. PATENT DOCUMENTS 3,434,471 A 3/1969 Liston
4,237,877 A 12/1980 Boehler
4,502,480 A 3/1985 Yamamoto
4,829,997 A 5/1989 Douwens
5,083,011 A * 1/1992 Munroe ..... G05D 23/275 219/491
5,193,347 A * 3/1993 Apisdorf ..... A42B 3/285 2/171.3
5,245,994 A 9/1993 Chang
5,671,730 A * 9/1997 Ollila ..... A62B 18/006 128/202.22
5,920,018 A * 7/1999 Wilkerson ..... G01F 1/74 73/861.41
5,921,467 A 7/1999 Larson
6,472,988 B1 * 10/2002 Feld ..... A62B 9/006 340/539.1
6,575,165 B1 6/2003 Cook
6,666,209 B2 12/2003 Bennett
6,796,304 B2 9/2004 Odell
2007/0137646 A1 * 6/2007 Weinstein ..... A61M 16/16 128/204.17
2010/0043793 A1 2/2010 Koulechov
2011/0116908 A1 * 5/2011 Thies ..... F01D 17/06 415/118
2011/0146679 A1 6/2011 Heesch
2011/0162647 A1 * 7/2011 Huby ..... A61M 16/0057 128/203.14
2012/0138051 A1 * 6/2012 Curran ..... A62B 7/10 128/201.25
2014/0373846 A1 * 12/2014 Kao ..... A62B 7/10 128/204.23

FOREIGN PATENT DOCUMENTS

WO WO 2000025615 5/2000
WO WO 2004064909 8/2004

OTHER PUBLICATIONS

3M Respiratory Products p. 6, http://www.westernsafety.com/3m/3mrespiratorypg6.html, Mar. 15, 2012.

* cited by examiner

HEATING FOR POWERED AIR UNIT

TECHNICAL FIELD

The present invention relates to the field of powered air units, and specifically, powered air purifying respirators (PAPRs). More specifically still, the present invention relates to heating air filtered through a PAPR.

BACKGROUND

Systems that use a powered air source to supply clean air to the wearer are generally referred to as powered air purifying respirators—known shorthand as "PAPRs". PAPRs typically include a powered air component that is connected to a facepiece via a hose. The facepiece is worn at least over the nose and mouth of the user (it also may cover the eyes and ears, or in some cases, the entire head), and the powered air component is commonly worn about the user's waist. In some cases, the facepiece may be another device, such as a welding helmet. The PAPR often includes filters, a housing, a fan, and an electric motor that drives the fan. Ambient air is filtered by being forced through filters consisting of filter elements contained within the filter cartridges. This filtered air is then delivered to the facepiece through a hose. The electrically powered fan draws air through the filter cartridges, through the hose, and into the facepiece interior. Because the fan does the work required for air movement through the PAPR system, the user is able to comfortably receive a clean supply of air with little effort. Representative examples of known PAPRs are described in the following patents: U.S. Pat. No. 6,796,304 to Odell et al., U.S. Pat. No. 6,575,165 to Cook et al., and U.S. Pat. No. 6,666,209 to Bennett et al.

As described, a PAPR draws ambient air through various elements, such as a filter, and the air then flows directly into the face area of a wearer of the PAPR. Depending on the temperature of the ambient air, the air flow reaching a wearer's face may feel cold or uncomfortable due to the velocity of the air flow or the temperature of the ambient air. A constant supply of cool air can also be dangerous to a wearer of a PAPR. It may cause fog to build up on glass inside a face piece or welding helmet, and it may also cause increased sickness.

SUMMARY

The present invention provides systems for preventing the flow of excessively cool air to a wearer's face. Additionally, the present invention provides appropriate controls to prevent overheating of the system for increased safety.

In one embodiment, the present invention includes a powered air purifying respirator (PAPR) with an active heating system. The PAPR includes a powered air component designed to be carried by a user of the PAPR, the powered air component includes a fan and a filter, and the fan draws air from a user's environment and through the filter. The PAPR further includes an electronically controlled active heating element and a control system. The control system varies the power provided to the heating element and further disables the heating element when potential overheating of the heating element is detected.

In another embodiment, the present invention provides a self-contained heating module for use with a PAPR. The heating module includes an electronically controlled active heating element configured to be disposed downstream of a filter in the PAPR. The heating module also includes a control system including a sensor. The sensor detects rotation of a fan in the PAPR. The control system disables the heating element when the fan is not rotating.

In a third aspect, the present invention provides a self-contained heating module for use with a powered air purifying respirator (PAPR). The heating module includes an active electronically controlled heating element configured to be disposed downstream of a filter in the PAPR. The heating module further includes a communication module. The communication module communicates with the PAPR to determine whether a fan in the PAPR is rotating, and the communication module sends a signal to a control system indicating a rotation status of the fan. The control system disables the heating element when the fan is not rotating.

BRIEF DESCRIPTION OF DRAWINGS

The following figures provide illustrations of the present invention. They are intended to further describe and clarify the invention, but not to limit scope of the invention.

Like numbers are generally used to refer to like components. The drawings are not to scale and are for illustrative purposes only.

DETAILED DESCRIPTION

Figure 1:
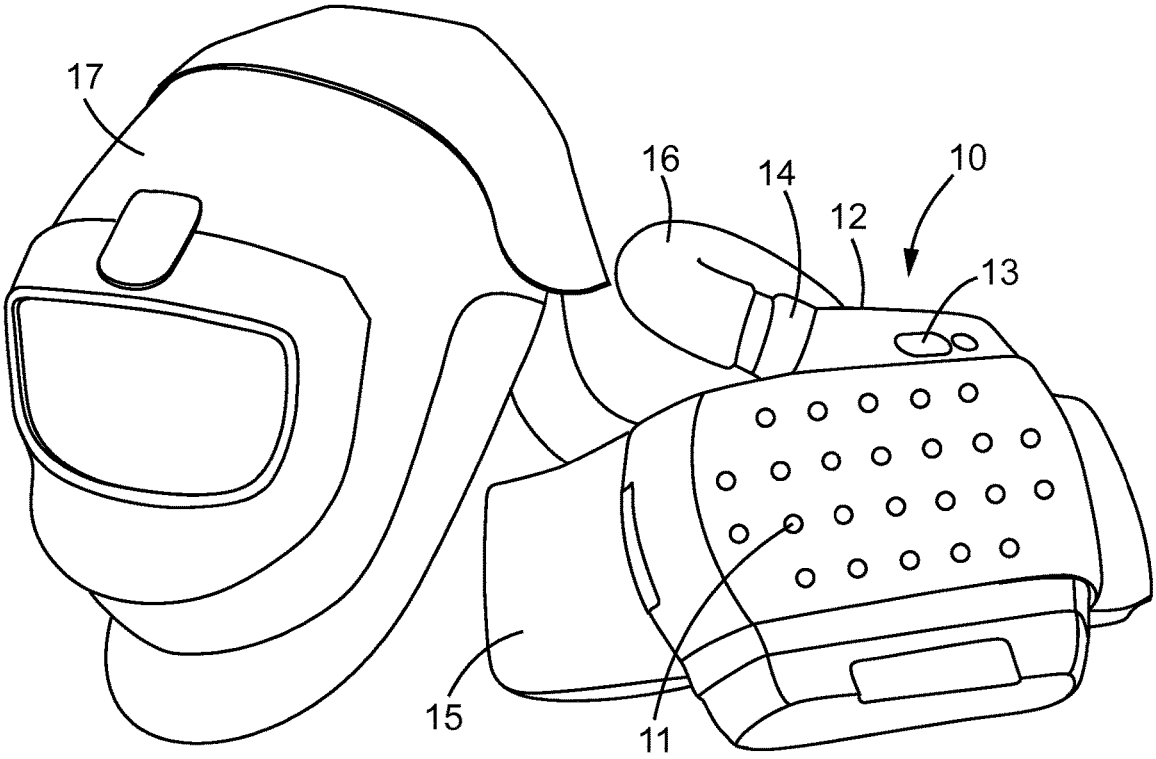
FIG. 1 shows an exemplary PAPR connected to a welding helmet.

FIG. 1 shows an exemplary PAPR 10 with an active heating system connected to a welding helmet. PAPR 10 filters air by drawing ambient air through air inlet 11 with a fan. A filter is disposed downstream of air inlet 11 and the fan pulls ambient air through the filter. An electronically controlled active heating element, such as one where the temperature or power to the heating system is controlled by a controller or control system, heats the air after it passes through the filter. Filtered and heated air is then routed through air outlet 14, through hose 16 and to the area around a wearer's face within welding helmet 17. A control system varies the power provided to the heating element and disables the heating element when potential overheating of the heating element is detected.

One consideration with a heating element is the importance of preventing overheating. Potential overheating of PAPR 10 can be determined in a variety of ways. For example, PAPR 10 may include a sensor that measures the temperature near or on the heating element to determine potential overheating. Potential overheating may also be determined by measuring the fan speed. Fan speed can be measured using an optical, capacitive or inductive sensor, or by detecting the fan speed from the fan motor. Alternatively, fan speed can be inferred by measuring the air flow passing through any given point in the PAPR, for example, the air flow exiting air outlet 14. Air flow can be measured with a mass flow sensor. Air flow can also be measured using a flap component attached at a location within the PAPR, such as near air outlet 14, such that the flap is moved or displaced by air flowing through the device. Other ways of detecting or measuring air flow will be apparent to one of skill in the art upon reading the present disclosure. Once air flow or fan speed are detected or measured, if there is insufficient air flow, a control system interfaced with the electronically controlled active heating element may reduce or remove power supplied to the heating element to prevent overheating.

In some embodiments, the PAPR 10 may also include a passive heating element. A passive heating element typically includes a heated mass that generates heat in the air passing through the area near and around the heated mass. Passive heating elements may also be referred to as stored heating elements. A passive heating element may be used in addition to the active heating element. Because a passive heating element stores heat, it would allow a wearer to unplug the PAPR device or heating element and still benefit from heated air without the heating element requiring any additional power.

PAPR 10 may also include a thermostat to control power to the heating element. The heating element in PAPR 10 may provide a variety of types of heat. It may be an electric heating element such as a Peltier heating system, a resistive heating system, a chemical or exothermic heating element, or a phase change heating system.

A heating element may be disposed in a variety of locations with respect to PAPR 10. For example, it may be integrated into the body of PAPR 10 such that it heats air upstream of the fan. Alternatively, it may be integrated into hose 16 to heat air downstream of the fan before the air reaches the face of a wearer.

PAPR 10 can be worn using belt 15, which can be secured about a wearer's waist, with the PAPR 10 device disposed adjacent to a wearer's back. PAPR 10 can be battery powered and battery life indicator 13 can provide a visual indication of how much battery charge remains. In another embodiment, PAPR 10 may be powered through an electrical connection to a power outlet or through some other means.

Figure 2:
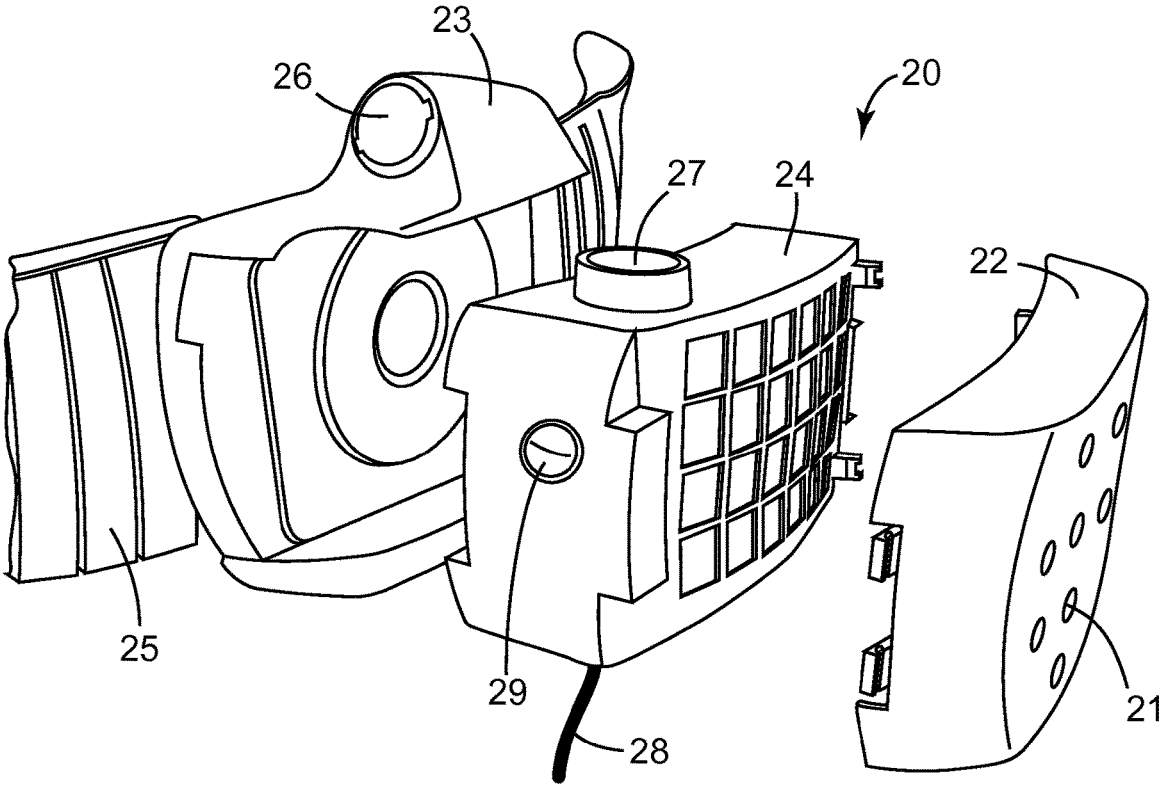
FIG. 2 shows an exploded view of a PAPR with a heating module.

FIG. 2 shows an exploded view of a PAPR 20 with a self-contained heating module 24. In another instance, a self-contained heating module 24 may be adapted to be integrated into PAPR 20 such that it is permanently integrated into PAPR 20. Self-contained heating module 24 may also be configured such that it snaps to or can otherwise be secured to a PAPR 20, so that it forms an integral but removable part of PAPR 20. In the configuration of FIG. 2, self-contained heating module 24 is configured to be secured between PAPR cover 22 and PAPR body 23.

When the self-contained heating module 24 as shown in FIG. 2 is integrated into a PAPR 20, air flows through air inlet 21 in PAPR cover 22 and is drawn through a filter disposed in PAPR cover 22. The air then is drawn through openings in the body of the self-contained heating module 24 and heated by a heating element contained therein. A fan disposed in PAPR body 23 draws air from the environment through the filter in PAPR cover 22 and heating module 24, and the air then passes through air outlet 26 to be guided by a hose to the face area of a wearer.

Self-contained heating module 24 may be powered by a separate power source than that for PAPR 20, such as through power cord 28. Self-contained heating module 24 may also have its own battery or other power source, or may share a power source with PAPR 20, such power source being housed either in the self-contained heating module 24 or PAPR 20. Self-contained heating module 24 may also have a separate power switch 29 and a temperature control knob 27. The temperature control knob 27 allows a wearer to adjust the level of heat provided to the filtered air passing through self-contained heating module 24 is exposed to.

In some embodiments, self-contained heating module 24 may include a sensor which detects the rotation of the fan in PAPR 20. The sensor may be any variety of sensor types, for example, a photodiode sensor, a capacitive sensor or an inductive sensor. The sensor provides feedback to a control system that controls the operation of self-contained heating module 24. For example, in the instance that the sensor is a reflective sensor containing a photodiode, the sensor can be used to detect a piece of reflective material on the fan to indicate whether the fan is moving. In such a configuration, a light is shone on the rotating fan. When the light reflects off the reflective portion of the fan, the reflected light is detected by the photodiode, indicating that the fan is rotating. The frequency with which the reflected light is detected indicates the frequency and thus the speed at which the fan is rotating. The control system may be configured to operate such that if the sensor detects that the fan is not rotating, the control system disables the heating element in the self-contained heating module 24.

The heating element in the self-contained heating module may be a variety of types of heating elements. For example, it may be an electronically controlled active heating element, it may be a passive heating element, or may include both types of heating elements.

Figure 3:
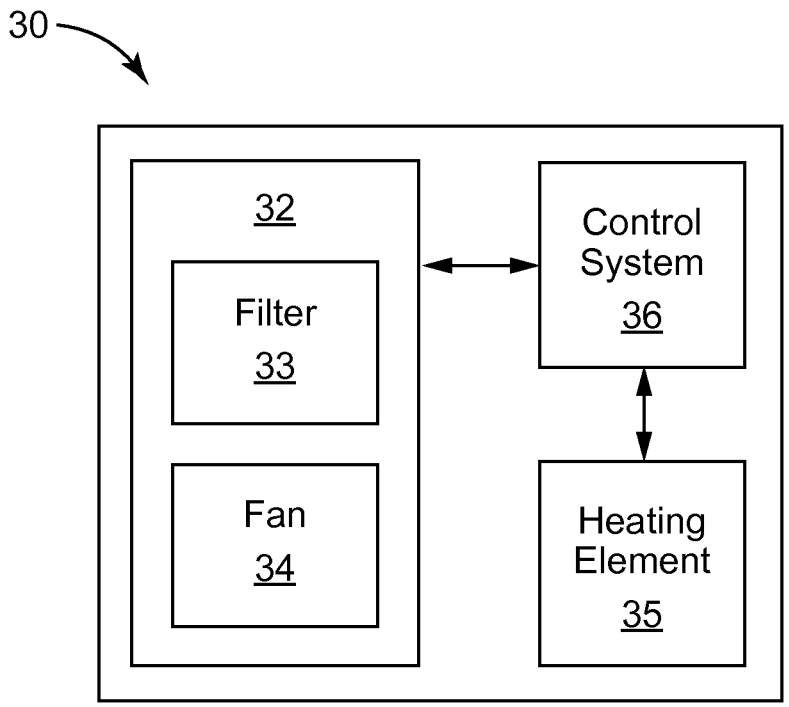
FIG. 3 shows a block diagram of a PAPR with a heating element.

FIG. 3 shows a block diagram of a PAPR 30 with a heating element 35. As discussed, PAPR 30 includes powered air component 32, including fan 34 which draws environmental air first through filter 33 then through heating element 35. Heating element 35 may be an active electronically controlled heating element, a passive heating element, or may include both types of heating elements. Control system 36 controls the operation of heating element 35 and may also control the operation of powered air component 32. Control system 36 may be configured to disable the operation of heating element 35, or eliminate power to heating element 35, when fan 34 in powered air component 32 is not rotating.

Figure 4:
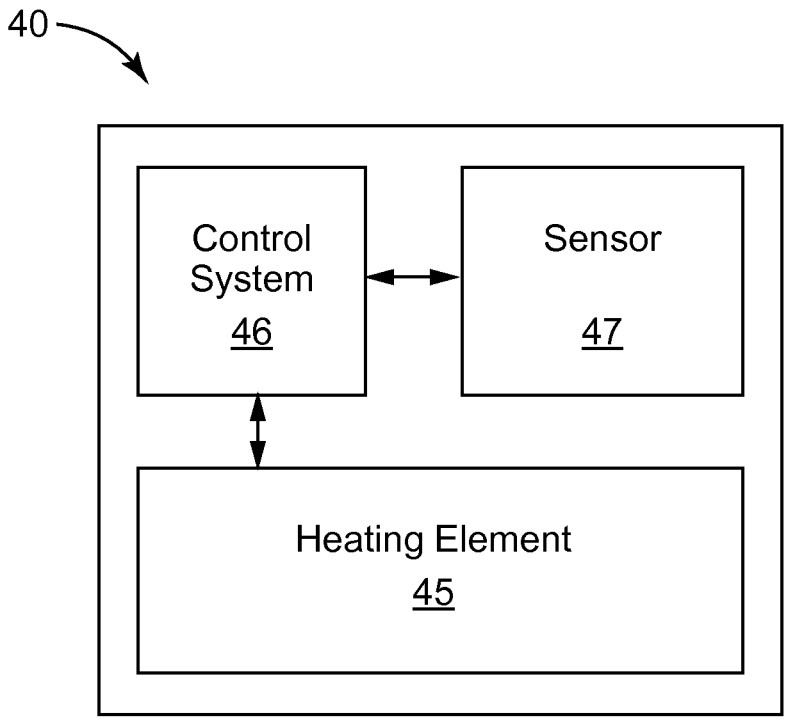
FIG. 4 shows a block diagram of a heating module with a sensor for use with a PAPR.

FIG. 4 shows a block diagram of a heating module 40 with a sensor for use with a PAPR. Heating module 40 may be self contained such that it is attached to a location on a PAPR, such as being attached to the body of the PAPR or to a hose. In another configuration, heating module 40 may be integrally attached to a PAPR such that to a wearer the PAPR and heating module 40 appear to form a singular unit. Heating module 40 may include a control system 46, sensor 47 and heating element 45. Heating element 45 may be an active electronically controlled heating element, a passive heating element, or may include both types of heating elements. In some embodiments, heating element 45 may be a heat transfer element. A heat transfer element could be configured such that it can be connected with an external element. The external element would heat fluid and maintain it at a desired temperature. The external element, when connected to heating element 45, would then circulate warm fluid through heating element 45 to heat air being filtered by a PAPR.

Control system 46 controls the operation of heating element 45. Sensor 47 detects whether the fan in the PAPR is rotating. Sensor 47 may be a variety of types of sensors, for example, a photodiode sensor, capacitive sensor or inductive sensor. Control system 46 may be configured to disable the operation of heating element 45, or eliminate power to heating element 45, when sensor 47 detects that the fan in the PAPR is not rotating.

Figure 5:
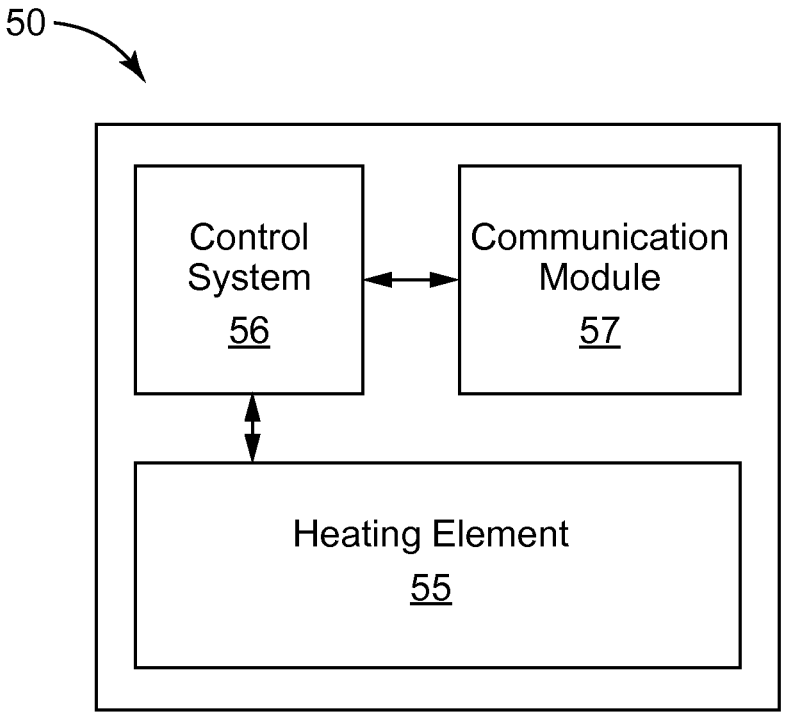
FIG. 5 shows a block diagram of a heating module with a communication module for use with a PAPR.

FIG. 5 shows a block diagram of a heating module 50 with a communication module 57 for use with a PAPR. Heating module 50 may be self contained such that it is attached to a location on a PAPR, such as being attached to the body of the PAPR or to a hose. In another configuration, heating module 50 may be integrally attached to a PAPR such that to a wearer the PAPR and heating module 50 appear to form a singular unit. Heating module 50 may include a control system 56, communication module 57 and heating element 55. Heating element 55 may be an active electronically controlled heating element, a passive heating element, or may include both types of heating elements. Control system 56 controls the operation of heating element 55. Communication module 57 communicates with a communication module in a PAPR that heating module 50 is used in conjunction with. Communication module 57 may receive communicate with the PAPR in a variety of ways, such as via a radio link or a wired connection. Communication module 57 may receive a variety of information from the PAPR, such as information indicating that the fan has stopped rotating or that there is risk of the device overheating. Control system 56 may then disable or remove the power to the heating element 55 to prevent overheating of the heating module 50.

While the present disclosure describes a particular embodiment of the present inventions, variations on the present invention will be apparent to one of ordinary skill in the art upon reading the disclosure. For example, a heating module may be connected to or integrated with a PAPR in a variety of ways, or a variety of sensors may be used to detect fan rotation. Further, there are many ways to disable a heating element when potential overheating is detected. Other variations will be apparent to one of skill in the art upon reading the present application. Such variations are intended to be included within the scope of the present disclosure.

What is claimed is:

1. A powered air purifying respirator (PAPR) configured to be worn on a body of a user, the PAPR comprising:

a facepiece configured to be worn over a nose and a mouth of the user;

a PAPR housing configured to be worn on the body of the user, the PAPR housing comprising:

a powered air component designed to be carried by the user of the PAPR, the powered air component including a fan and a filter, wherein the fan draws air from an environment of the user through the filter to filter an air flow;

an electronically controlled active heating element configured to heat the air flow as the air flow is drawn past the active heating element;

an air outlet configured to receive the air flow, and to route the air flow to an area configured to provide a heated air flow to the user;

a control system, comprising at least one of a photodiode sensor that detects rotation of the fan based on a frequency with which reflected light is detected from a reflective portion of the fan, a capacitive sensor that detects rotation of the fan, or an inductive sensor that detects rotation of the fan, wherein the control system is configured to:

receive feedback comprising a measurement by the at least one of the photodiode sensor, capacitive sensor, or inductive sensor of the air flow based on the rotation of the fan, and detect an insufficient air flow based on the measurement of the air flow;

in response to detection of the insufficient air flow, reduce power provided to the active heating element to prevent overheating of the active heating element;

communicate, via wireless communication, information based at least in part on the detection of the insufficient air flow; and a hose coupled to the PAPR housing and the facepiece, and wherein the air flow is transferrable from the air outlet of the PAPR housing to the facepiece via the hose.

2. The PAPR of claim 1, additionally comprising a passive heating element.

3. The PAPR of claim 1, wherein the active heating element is a heat transfer element.

4. The PAPR of claim 1, further comprising a thermostat to control the power to the active heating element.

5. The PAPR of claim 1, wherein the active heating element is integrated into the hose.

6. The PAPR of claim 1, wherein the active heating element is an electric heating element.

7. The PAPR of claim 1, wherein the control system further comprises a sensor that measures the air flow passing through the PAPR, and wherein the feedback received by the control system includes a signal provided by the sensor corresponding to a measurement of the air flow passing through the PAPR.

8. The PAPR of claim 1, wherein the control system further comprises a sensor that measures a speed of the fan, and wherein the feedback received by the control system includes a signal provided by the sensor corresponding to a measured speed of the fan.

9. The PAPR of claim 1, wherein the control system comprises the photodiode sensor that detects rotation of the fan based on a frequency with which reflected light is detected from a reflective portion of the fan, and wherein the photodiode sensor is configured to detect the reflective portion of the fan that indicates fan rotation.

10. The PAPR of claim 9, wherein the control system includes a light source that projects light on the fan, wherein the reflected light from the reflective portion of the fan is detected by the photodiode sensor, and wherein the photodiode sensor generates an output that indicates fan rotation.

11. The PAPR of claim 10, wherein a frequency with which the reflected light is detected by the photodiode sensor indicates a speed of the rotation.

12. The PAPR of claim 1, wherein the information is based at least in part on the fan has stopped rotating or a potential overheating of the active heating element based on the detection of insufficient air flow.

13. The PAPR of claim 1, wherein the electronically controlled active heating element is an integral, removable module securable at the PAPR.

14. The PAPR of claim 1, wherein the facepiece is a welding helmet.

15. The PAPR of claim 1, wherein the facepiece is configured to cover an entire head of the user.

16. A powered air purifying respirator (PAPR) configured to be worn on a body of a user, the PAPR comprising:

a facepiece configured to be worn over a nose and a mouth of the user;

a PAPR housing configured to be worn on the body of the user, the PAPR housing comprising:

a powered air component designed to be carried by the user of the PAPR, the powered air component including a fan and a filter, wherein the fan draws air from an environment of the user through the filter to filter an air flow;

an electronically controlled active heating element configured to heat the air flow as the air flow is drawn past the active heating element;

an air outlet configured to receive the air flow, and to route the air flow to an area configured to provide a heated air flow to the user, a control system, comprising at least one of a photodiode sensor that detects movement of the fan based on a frequency with which reflected light is detected from a reflective portion of the fan, a capacitive sensor that detects rotation of the fan, or an inductive sensor that detects rotation of the fan, wherein the control system is configured to:

receive feedback comprising a measurement by the photodiode sensor of the air flow based on the movement of the fan and to detect an insufficient air flow based on the measurement of the air flow based on movement of the fan, and in response to detection of the insufficient air flow, reduce power provided to the active heating element to prevent overheating of the active heating element and communicate, via wireless communication, information based at least in part on the detection of the insufficient air flow and movement of the fan; and a hose coupled to the PAPR housing and the facepiece, and wherein the air flow is transferrable from the air outlet of the PAPR housing to the facepiece via the hose.

17. The PAPR of claim 16, wherein the photodiode sensor is configured to detect the reflective portion of the fan that indicates movement of the fan.

18. The PAPR of claim 17, wherein the control system includes a light source that projects light on the fan, wherein the reflected light from the reflective portion of the fan is detected by the photodiode sensor, and wherein the photodiode sensor generates an output that indicates fan rotation.

19. The PAPR of claim 18, wherein a frequency with which the reflected light is detected by the photodiode sensor indicates a speed of the rotation.

20. The PAPR of claim 16, wherein the information is based at least in part on the fan has stopped rotating or a potential overheating of the active heating element based on the detection of insufficient air flow.

* * * * *